United States Patent [19]

Rachedi

[11] 4,401,092

[45] Aug. 30, 1983

[54] EXHAUST GAS RECIRCULATION SYSTEM

[75] Inventor: Shane H. Rachedi, Dearborn, Mich.

[73] Assignee: Ford Motor Company, Dearborn, Mich.

[21] Appl. No.: 287,846

[22] Filed: Jul. 29, 1981

[51] Int. Cl.[3] ..... F02M 25/06

[52] U.S. Cl. ..... 123/568

[58] Field of Search ..... 123/568

[56] References Cited

U.S. PATENT DOCUMENTS

| | | | |
|---|---|---|---|
| 3,641,989 | 2/1972 | Hill | 123/568 |
| 3,880,129 | 4/1975 | Hollis, Jr. | 123/568 |
| 3,981,283 | 9/1976 | Kaufman | 123/568 |
| 3,982,515 | 9/1976 | Bradshaw | 123/568 |
| 4,128,090 | 12/1978 | Aoyama | 123/568 |
| 4,130,093 | 12/1978 | Aoyama | 123/568 |
| 4,178,896 | 12/1979 | Horikoshi et al. | 123/568 |
| 4,186,698 | 2/1980 | Aoyama | 123/568 |
| 4,285,318 | 8/1981 | Yoneda et al. | 123/568 |

*Primary Examiner*—Wendell E. Burns

*Attorney, Agent, or Firm*—Robert E. McCollum; Clifford L. Sadler

[57] ABSTRACT

An engine exhaust gas recirculation (EGR) system is provided in which a sonic flow EGR valve is moved to open positions to establish a different constant rate of flow at each open position of the EGR valve in response to air pressure acting on a servo means secured to the valve, the air pressure force being controlled by changes in a control vacuum opposing the air pressure force and modified by an air bleed device as a function of changes in engine exhaust gas backpressure levels, to provide an EGR valve movement that varies essentially in proportion to changes in engine air flow.

2 Claims, 3 Drawing Figures

EXHAUST GAS RECIRCULATION SYSTEM

Figure 1:
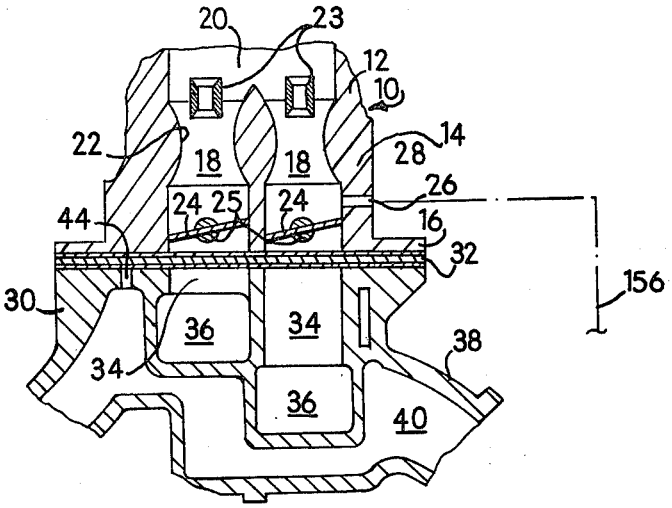

This invention relates in general to an exhaust gas recirculation (EGR) system for an automotive type internal combustion engine. More particularly, it relates to a sonic flow EGR valve means operated by servo means that is controlled as a function of changes in the pressure in the engine exhaust manifold.

Many of the EGR systems in use today are of the so called exhaust gas backpressure control type. That is, they operate on the principle of establishing a constant pressure chamber upstream of the EGR valve in the exhaust manifold passage. The movement of the EGR valve is controlled as a function of changes in exhaust gas backpressure to maintain the chamber pressure constant by variably bleeding air into a control vacuum used to actuate the EGR valve to its various positions until the EGR valve moves to regulate the pressure in the control chamber to the constant value. The maximum rate of flow through the valve, therefore, will be determined by the maximum pressure differential between the exhaust backpressure and the control chamber pressure. Since the range of exhaust backpressure changes is relatively small compared to the range of intake manifold vacuum changes, the maximum flow rate will be limited. Also, since flow through the valve is not at sonic velocity, the rate of flow will not be constant at any one position of the valve. Examples of such systems are shown in U.S. Pat. Nos. 3,880,129, Hollis, 4,178,896, Horikoski et al, 4,128,090, Aoyama, and 4,186,698, Aoyama.

Some known constructions of EGR valves use carburetor venturi vacuum or so-called ported vacuum to control movement of the air bleed valve to provide an EGR rate of flow that is essentially proportional to the air flow through the engine. See, for example, U.S. Pat. No. 4,130,093, Aoyama, and Horikoski, referred to above.

In each of the above cases, the position of the EGR valve is a function of the regulatory movement of the EGR valve with exhaust gas backpressure changes to reestablish the control pressure chamber pressure as a constant. The rate of flow through the valve, therefore, will be limited by the diameter of the orifice or flow restrictor upstream of the EGR valve defining the control chamber.

It is a primary object of this invention to provide an EGR valve assembly and system that provides a greater maximum rate of EGR flow that varies as a function of the pressure differential between engine exhaust backpressure and engine intake manifold vaccum; also, one that varies essentially proportional to engine air flow; and one having an EGR valve providing a constant rate of flow through the valve for each open position of the valve, and at a rate of flow that is independent of pressure variations downstream of the valve. Such an object is obtained by the use of a sonic flow EGR valve that is exposed to the engine exhaust backpressure on one side of the valve and manifold vacuum on the other side, and one in which the rate of flow past the valve is maintained at sonic velocity over essentially the entire operating range of the engine. Sonic flow or flow at the velocity of sound provides a constant pressure past the valve opening and, therefore, a constant rate of flow. Accordingly, the rate of flow through the valve will vary in direct proportion to the area opening of the valve and will be independent of the pressure variations downstream of the valve. The rate of flow, therefore, is not dependent upon the maintenance of a constant pressure chamber upstream of the EGR valve as is the case in some of the prior art devices.

It is another object of the invention, therefore, to provide an EGR system that includes a sonic flow EGR valve whose position is varied in direct proportion to changes in the pressure in the exhaust manifold by the modulation of the level of a control vacuum used to move the valve to its various positions.

The invention is exemplified by alternate embodiments which utilize atmospheric air pressure as the motivating force for opening the EGR valve, and a control vacuum chamber that is variably bled with atmospheric air as a function of changes in the exhaust manifold pressure to schedule the movement of the EGR valve.

The use of a control vacuum per se for the actuation of the EGR valve, in general, is known. For example, U.S. Pat. No. 3,641,989, Hill, shows in FIG. 3 a carburetor ported vacuum actuated EGR valve. However, it will be noted that in contrast to the constructions of this invention, the Hill construction does not utilize a sonic flow EGR valve as described herein, does not include an EGR valve that is modulated by changes in exhaust manifold pressure, nor does it contain an air bleed device to provide the modulation described.

U.S. Pat. No. 3,982,515 shows a vacuum controlled EGR valve assembly including an air bleed valve for modifying the movement of the EGR valve. However, in this case, the EGR valve is not a sonic flow valve and the rate of flow through the EGr valve is not constant at each position of the valve.

It is a still further object of the invention, therefore, to provide an EGR system that maintains the rate of flow of EGR gases into the engine intake manifold constant at each open position of the EGR valve, the rate per se changing in direct proportion to the opening area of the EGR valve which is varied as a direct function of the changes in exhaust gas pressure levels.

Figure 2:
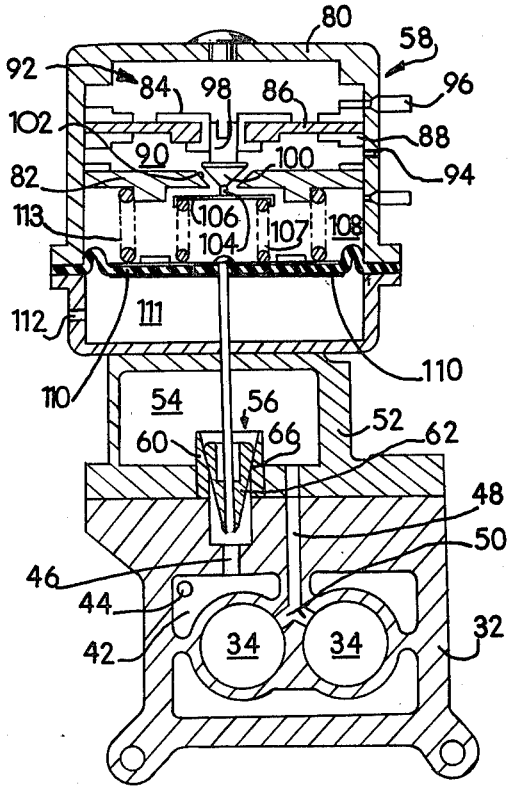
Figure 3:
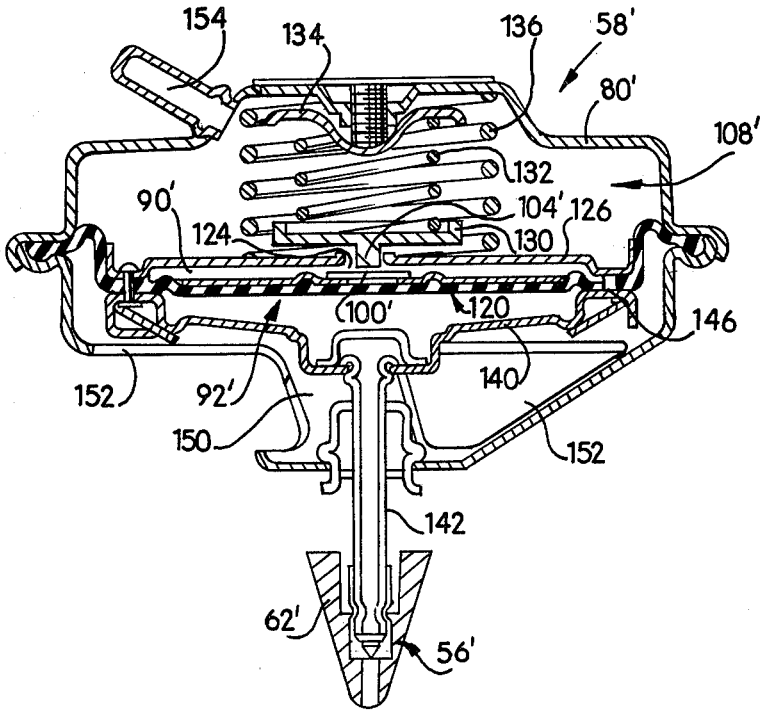

Other objects, features, and advantages of the invention will become more apparent upon reference to the succeeding detailed description thereof, and to the drawings illustrating the preferred embodiments thereof; wherein, FIG. 1 is a schematic illustration, with parts broken away and in section, of an exhaust gas recirculation system embodying the invention;

FIG. 2 is a cross-sectional view taken on a plane indicated by and viewed in the direction of the arrows 2—2 of FIG. 1; and, FIG. 3 is an enlarged cross-sectional view of an alternative embodiment of the invention.

FIG. 1 illustrates a portion 10 of a two-barrel carburetor of a known downdraft type. It has an air horn section 12, a main body portion 14, and a throttle body 16, joined by suitable means not shown. The usual air/fuel induction passages 18 are provided open at their upper ends 20 to fresh air from an air cleaner, not shown, and connected at their lower ends to the engine intake manifold 30. Fixed area venturies 22 cooperate with boost venturies 23 through which the main supply of fuel is induced, by means not shown.

Flow of air and fuel through induction passages 18 is controlled by a pair of throttle valve plates 24 each fixed on a shaft 25 rotatably mounted in the side walls of the carburetor body.

The induction passages also contain a pressure sensing port; that is, a so-called exhaust gas recirculation (EGR) vacuum sensing port 26. The latter is adjacent the edge of the throttle valve 24 in its closed position so as to be traversed by the edge as the throttle valve moves to open positions. This progressively exposes the port to manifold vacuum and thus provides a port vacuum level that varies as a function of throttle valve position.

The throttle body 16 is flanged as indicated for bolting to the top of the engine intake manifold 30, with a spacer element 32 located between. Manifold 30 has a number of vertical risers or bores 34 that are aligned for cooperation with the discharge end of the carburetor induction passages 18. The risers 34 extend at right angles at their lower ends 36 for passage of the mixture out of the plane of the figure to the intake valves of the engine.

The exhaust manifolding part of the engine cylinder head is indicated partially at 38, and includes an exhaust gas crossover passage 40. The latter passes from the exhaust manifold on one side of the engine to the opposite side beneath the manifold trunks 36 to provide the usual "hot spot" beneath the carburetor to better vaporize the air/fuel mixture.

As best seen in FIG. 2, the spacer 32 is provided with a worm-like recess 42 that is connected directly to crossover passage 40 by a bore 44, as seen in FIG. 1. Also connected to passage 42 is a passage 46 alternately blocked or connected to a central bore or passage 48 communicating with the risers 34 through a pair of ports 50. Mounted to one side of the spacer is a cup-shaped boss 52 forming a chamber 54 through which passages 46 and 48 are interconnected.

To prevent the recirculation of exhaust gases at undesirable times, passage 46 normally is closed by an EGR valve 56 that is moved to an open position by a servo means 58. EGR valve 56 in this case is a sonic flow control valve, similar to that fully shown and described in U.S. Pat. No. 3,981,283, Kaufman. That is, the walls of the valve seat nozzle 60 are shaped so as together with the conical like plug valve or pintle 62 form a convergent-divergent flow passage with sonic flow, i.e., at the speed of sound, at the throat 66 between the two for each open position of the movable plug valve 62.

As seen in FIG. 2, the servo 58 consists of a one-piece main housing 80 divided by a central partition 82 into upper and lower parts. The upper part contains a tubular rigid support 84 to which is assembled an annular flexible diaphragm 86. The latter is edge mounted into housing 80 with rigid fixed members 88. Diaphragm 86 divides the upper part into an air chamber 90 and an exhaust gas backpressure chamber 92. Chamber 90 is connected to air at atmospheric pressure through a vent 94. Chamber 92 is connected by a pressure sensing port 96 to a port, not shown, in the exhaust manifold so as to be responsive to the exhaust gas backpressure changes.

Adjustably mounted within the hollow center of tubular support 84 is a plunger 98. The lower end 100 of the plunger is conically shaped as a valve for cooperation with a matingly shaped seat 102 formed in partition 82. Together they constitute an air bleed valve assembly. The plunger has a stem end 104 engaged by a flat plate 106 biased upwardly by a feedback or positioning spring 107.

Bleed valve 100 moves vertically to control the flow of bleed air from atmospheric air chamber 90 into a control vacuum chamber 108 defined between partition 82 and a lower or second annular flexible diaphragm 110. Chamber 108 is connected through a reservoir, not shown, to any suitable source of vacuum such as, for example, the ported vacuum in EGR port 26 adjacent throttle valve 24, or manifold vacuum, or any other suitable source of vacuum, so long as the vacuum is at a constant level such as would be provided by an accumulator. An on-off electrically controlled valve could be used to schedule the input of vacuum to chamber 108 as desired.

The lower diaphragm 110 in this case is fixedly connected to EGR valve 56. Its lower surface is subjected to ambient air pressure in a chamber 111 vented to air at atmospheric pressure through an opening 112. The diaphragm moves EGR valve 56 as a function of the differential between the ambient pressure and the control vacuum in chamber 108. A spring 113 normally biases diaphragm 110 downwardly as shown to close the EGR valve 56.

As stated previously, the EGR valve 56 is a sonic flow control valve. That is, the velocity of the flow through the throat of the C-D nozzle is at the speed of sound and, therefore, constant for each position of the EGR valve. The pressure at the throat, therefore, is a constant, and the rate of flow will also be constant for each position of the pintle 62. Therefore, the rate of flow will vary in direct proportion to the opening area of the valve. Since the opening area of the valve varies as a direct function of the stroke, it will vary as a direct function of the changes in the pressure in the exhaust manifold. Since the flow through the EGR valve is sonic, it will be independent of pressure changes downstream of the valve.

In this case, therefore, the atmospheric air pressure acting against the bottom of diaphragm 110 will cause movement of the EGR valve as a function of the level of vacuum in chamber 108. The latter will be modified by the action of air bleed valve 100 controlled in accordance with the position of plunger 98 that will be located as a function of the changes in the exhaust manifold pressure in chamber 92. The latter varies essentially as a function of engine air flow.

In operation, therefore, in brief, the engine idle speed positions of the parts are as shown in FIG. 2. With throttle valve 24 closed, and assuming chamber 108 disconnected from the constant vacuum source chamber 108 will be at atmospheric pressure. The exhaust backpressure level is low. Therefore, regardless of the position of air bleed valve 100, no movement of EGR valve 56 will result. Spring 113 will maintain the valve seated. A similar result will occur at engine wide open throttle condition of operation by dumping the vacuum chamber 108. The bleed valve will be open and spring 113 again will maintain the EGR valve 56 seated.

Opening of throttle valve 24 for part throttle operation, however, will cause an increase in exhaust gas backpressure and connect vacuum to chamber 108. This results in the upper diaphragm 86 being pushed downwardly by the exhaust gas pressure to move the air bleed valve 100 towards closing the vent 102. The non-decaying vacuum in chamber 108 provides a pressure differential on opposite sides of diaphragm 110 allowing air pressure to move diaphragm 110 upwardly. This will open EGR valve 56 by an amount that will vary with the corresponding increase in exhaust gas backpressure. The upward movement of the EGR valve will continue for further opening of the throttle valve 24 until the force of feedback spring 107 balanced against the exhaust gas backpressure level causes bleed valve 100 to seek an equilibrium position between open and shut to maintain the EGR valve in the position scheduled for that particular opening position of the throttle valve. A different new rate of flow of EGR gases through the EGR passage to the intake manifold of the engine then will be established.

Continued increased opening of throttle valve 24 will continue to open the EGR valve 56 as a result of the increase in exhaust gas backpressure level until the wide open throttle condition is reached. As stated above, at this point, the EGR valve 56 will close because the vacuum in chamber 108 then will be cut off, causing the chamber to be at an atmospheric pressure level, permitting spring 113 to close the EGR valve.

FIG. 3 shows an alternate embodiment of the invention utilizing a single diaphragm to accomplish results similar to that provided by the construction of FIG. 2.

More particularly, FIG. 3 shows a servo means 58' having a two-piece outer housing 80' partitioned into upper and lower compartments by an annular flexible diaphragm 120. The upper surface of the diaphragm has secured to it a flat plate type bleed valve 100' that is adapted to seat against a vent 124 formed in a plate 126 fixed at outer edges to diaphragm 120. Projecting through vent 124 at times is an actuator or plunger 104' formed on the bottom of a spring seat 130 biased towards the vent by a position feedback spring 132. The opposite end of spring 132 is seated against an adjustable stop 134 threadably mounted to housing 80'. A second spring 136 biases diaphragm 120 downwardly as shown.

Secured to the underside of diaphragm 120 is a subhousing 140 to which is attached the stem 142 of sonic flow EGR valve 56'. The stem 142 is hollow, as is the EGR valve pintle 62', to allow exhaust gases to communicate at all times directly with the chamber 92' defined between the subhousing 140 and diaphragm 120. One portion of subhousing 140 adjacent its outer edge is provided with one or more holes 146 that align with similar holes in the diaphragm 120 to establish an ambient air chamber 90' between the upper surface of diaphragm 120 and plate 126. Air is admitted to holes 146 from chamber 150 formed between housing 80' and subhousing 140. The lower part of housing 80' actually is a spoked type support with the open spaces between the spokes being indicated at 152. These open spaces are in communication with the atmosphere.

Completing the construction, the upper chamber 108' is connected through a reservoir, not shown, to a control vacuum source, such as EGR port 26, through an adapter 154 and a line 156 shown in FIG. 1.

Thus, it will be seen that the FIG. 3 construction is functionally similar to that of the FIG. 2 embodiment in that it contains a control vacuum chamber 108', an exhaust gas backpressure chamber 92', an air bleed valve assembly 100', 104', and an air chamber 90'.

The operation of the FIG. 3 embodiment also is similar to that of FIG. 2. At closed throttle (also wide open throttle conditions), chamber 108' will be disconnected from the vacuum source, and will be essentially atmospheric. Spring 136, therefore, will maintain EGR valve 56' closed. The exhaust gas backpressure will be low.

As throttle valve 24 is opened, the vacuum will be reconnected to chamber 108', and the exhaust gas backpressure in chamber 92' will increase. Together, the two will cause an upward movement of the diaphragm 120 and air bleed valve assembly 100', 104' to move open the EGR valve 56' an amount in proportion to the opening of throttle valve 24 providing the increase in exhaust gas backpressure. The feedback spring 132 will cause the bleed valve assembly to seek an equilibrium position, similar to that described in connection with the operation of the FIG. 2 embodiment.

From the foregoing, it will be seen that the invention provides an EGR system consisting of a one-piece integral assembly of a sonic flow EGR valve and a servo means to provide finite positions of the EGR valve as a function of changes in engine exhaust gas backpressure. It will also be seen that the use of a sonic EGR valve in the integral assembly described provides a constant rate of supply of EGR gas to the intake manifold for each open position of the valve, and a rate of flow that is independent of the pressure conditions downstream of the EGR valve, in contrast to devices in use today.

While the invention has been shown and described in its preferred embodiments, it will be clear to those skilled in the arts to which it pertains, that many changes and modifications may be made thereto without departing from the scope of the invention.

I claim:

1. An exhaust gas recirculation (EGR) system for use with an internal combustion engine having intake and exhaust manifolds and a pressure sensing port in the exhaust manifold for sensing the pressure changes therein, the system comprising;

an EGR duct connecting the gases from the exhaust manifold to the engine intake manifold, and a one-piece integral assembly of a spring closed sonic flow EGR valve means in the duct normally closing the duct to prevent recirculation of gases and movable to open positions in response to fluid pressure acting thereon, and a fluid pressure actuated servo means connected to the valve means for moving the valve means in response to the application of fluid pressure thereto, the servo means comprising a housing having first and second annular flexible diaphragms and a central partition dividing the housing into first and second parts on opposite sides of the partition, the first part containing an exhaust gas backpressure chamber and a first ambient air pressure chamber on opposite sides of the first diaphragm, the second part containing a control vacuum chamber and a second ambient air pressure chamber on opposite sides of the second diaphragm, means connecting a source of vacuum at constant pressure level to the vacuum chamber for effecting a movement of the second diaphragm, means connecting the second diaphragm to the EGR valve means, and means connecting the exhaust gas backpressure chamber to the exhaust manifold pressure port for controlling the movement of the first diaphragm as a function of the change in exhaust gas backpressure, the control vacuum chamber having an air bleed valve assembly operably associated therewith and connected to the first diaphragm to bleed the control vacuum at times in response to exhaust backpressure changes, the assembly including an air vent and an air bleed valve movably associated with the vent to control flow through the same, a part of the assembly being movable with the first diaphragm to control the bleed of air into the vacuum chamber to control the movement of the EGR valve means by the air pressure in the second air chamber as a function of the changes in exhaust backpressure and control vacuum, the partition having a hole therein connecting the first air chamber and the control vacuum chamber and constituting the vent at times receiving the bleed valve therein to close the vent in response to a predetermined movement of the first diaphragm in response to exhaust gas backpressure acting thereon to increase the pressure differential between the air pressure in the second air chamber and the control vacuum to thereby move the EGR valve, the EGR valve means consisting of an essentially conical pintle mounted for a reciprocating movement into and out of a stationary cooperatively shaped nozzle to define convergent-divergent flow paths at all open positions of the pintle for the flow of exhaust gases therethrough, the valve means being so designed and constructed to provide sonic flow through the valve means over essentially the entire vacuum operating level of the engine to thereby establish a constant rate of flow of exhaust gases through the valve means at each open position of the valve means, the rates of flow through the valve means thereby varying solely as a function of the area opening of the valve means as determined by the position of the pintle in response to the change in control vacuum level controlling the fluid pressure level acting on the servo means and being independent of the pressure level changes downstream of the valve means.

2. A system as in claim 1, the air bleed valve being spring mounted in the vacuum chamber for movement towards the vent hole in the partition to close the same at times, and other spring means biasing the EGR valve means to a closed position.

* * * * *